US008842055B2

(12) United States Patent
Murdock et al.

(10) Patent No.: US 8,842,055 B2
(45) Date of Patent: Sep. 23, 2014

(54) HIGH IMPEDANCE SURFACE

(75) Inventors: James N. Murdock, Austin, TX (US); Eunyoung Seok, Plano, TX (US); Brian P. Ginsburg, Allen, TX (US); Vijay B. Rentala, Plano, TX (US); Srinath Ramaswamy, Murphy, TX (US); Baher Haroun, Allen, TX (US)

(73) Assignee: Texas Instruments Incorporated, Dallas, TX (US)

( * ) Notice: Subject to any disclaimer, the term of this patent is extended or adjusted under 35 U.S.C. 154(b) by 566 days.

(21) Appl. No.: 13/116,885

(22) Filed: May 26, 2011

(65) Prior Publication Data

US 2012/0299797 A1 Nov. 29, 2012

(51) Int. Cl.

| | |
|---|---|
| ***H01Q 1/48*** | (2006.01) |
| ***H01Q 15/00*** | (2006.01) |
| ***H01Q 9/04*** | (2006.01) |
| ***H01Q 1/52*** | (2006.01) |

(52) U.S. Cl.

CPC ..... *H01Q 1/52* (2013.01); *H01Q 15/008* (2013.01); *H01Q 9/0407* (2013.01)

USPC ..... 343/893; 343/892

(58) Field of Classification Search

USPC ..... 343/893

See application file for complete search history.

(56) References Cited

U.S. PATENT DOCUMENTS

| | | | | |
|---|---|---|---|---|
| 6,476,771 | B1 * | 11/2002 | McKinzie, III | 343/756 |
| 6,628,242 | B1 | 9/2003 | Hacker et al. | |
| 6,670,932 | B1 | 12/2003 | Diaz et al. | |
| 6,967,621 | B1 | 11/2005 | Cadotte, Jr. et al. | |
| 7,136,028 | B2 | 11/2006 | Ramprasad et al. | |
| 7,136,029 | B2 | 11/2006 | Ramprasad et al. | |
| 7,197,800 | B2 | 4/2007 | Sievenpiper et al. | |
| 7,423,608 | B2 | 9/2008 | Dunn et al. | |
| 7,518,465 | B2 | 4/2009 | Savic et al. | |
| 8,604,987 | B1 * | 12/2013 | Doane | 343/725 |
| 2003/0011518 | A1 | 1/2003 | Sievenpiper et al. | |
| 2004/0066340 | A1 | 4/2004 | Hacker et al. | |
| 2005/0134521 | A1 | 6/2005 | Waltho | |
| 2009/0201220 | A1 | 8/2009 | Kim et al. | |

FOREIGN PATENT DOCUMENTS

| | | |
|---|---|---|
| EP | 1195847 | 4/2002 |
| JP | 2009105575 A | 5/2009 |

* cited by examiner

*Primary Examiner* — Matthew Mikels

(74) *Attorney, Agent, or Firm* — John R. Pessetto; Frederick J. Telecky, Jr.

(57) ABSTRACT

An apparatus for emitting radiation is provided. The apparatus comprises an antenna formed on a substrate, and a high impedance surface (HIS). The HIS has a plurality of cells formed on the substrate that are arranged to form an array that substantially surrounds at least a portion of the antenna. Each cell generally includes a ground plane, first plate, second plate, and an interconnect. The ground plane is formed on the substrate, while the first plate (which is substantially rectangular) is formed over and coupled to the ground plane. The first plate for each cell is also arranged so as to form a first checkered pattern for the array. The second plate (which is substantially rectangular) is formed over and is substantially parallel to the first plate. The first and second plates are also substantially aligned with a central axis that extends generally perpendicular to the first and second plates hand have a interconnect formed therebetween. The second plate for each cell is also arranged so as to form a second checkered pattern for the array.

3 Claims, 8 Drawing Sheets

HIGH IMPEDANCE SURFACE

TECHNICAL FIELD

The invention relates generally to a radio frequency (RF) antenna structures and, more particularly, to high impedance surfaces (HISs).

BACKGROUND

For high millimeter-wave frequencies (i.e., terahertz radiation), it is difficult to build adequate radiating structures. Typically, radiation is reflected within the package or substrate supporting the antenna, generating surface waves. At the edges of the package or substrate, the surface waves can generate parasitic currents that distort the wave pattern. To combat this problem, HISs have been employed to inhibit surface waves and generally prevent the parasitic currents that cause the wave pattern distortion.

Turning to FIGS. 1 and 2, an example of a conventional HIS 100 can be seen. This HIS 100 is generally comprised of an array of cells 102. Each cell 102 is generally comprised of a ground plane 106 (which typically underlies the entire array), via 108, and a plate 106. The plate 110 is part of a metallization layer (which can be formed of aluminum or copper) that is patterned to form the array. By using such an array, the reflection coefficient of the electric field has a zero phase, which causes the HIS to have a high impedance.

In FIGS. 3 and 4, another example of a conventional HIS 200 can be seen. Contrasting HIS 100 and HIS 200, HIS 100 has non-overlapping cells where the plates are generally hexagonal in shape, while HIS 200 employs lines of cells 202 and 204. As shown, the via 210 is slightly larger than via 204 so that the edge of plate 212 can overlap the edge of plate 208. By using this configuration, plates 208 and 212 are capacitively coupled or form a capacitor, which allowing the HIS 200 to be tuned to a lower frequency than HIS 100.

For HISs 100 and 200, however, there is great difficulty in producing an HIS that can be used for high millimeter-wave frequencies (i.e., terahertz radiation). Manufacturing processes (in many cases) may not have fine enough pitch resolution to produce the closely spaced cells for HIS 100 that would be functional in this desired frequency range, and the capacitive coupling for HIS 200 creates further complications as it tends to lower the resonant frequency. Therefore, there is a need for an HIS that can be used for high millimeter-wave frequencies (i.e., terahertz radiation).

Some other conventional structures are: U.S. Pat. Nos. 6,628,242; 6,670,932; 7,136,028; 7,136,029; 7,197,800; 7,423,608; 7,518,465; U.S. Patent Pre-Grant Publ. No. 2005/0134521; U.S. Patent Pre-Grant Publ. No. 2009.0201220; and European Patent No. EP1195847.

SUMMARY

An embodiment of the present invention, accordingly, provides an apparatus. The apparatus comprises an antenna formed on a substrate; and a high impedance surface (HIS) having a plurality of cells formed on the substrate, wherein the plurality of cells are arranged to form an array that substantially surrounds at least a portion of the antenna, and wherein each cell includes: a ground plane formed on the substrate; a first plate that is formed over and coupled to the ground plane, wherein the first plate is substantially rectangular, and wherein the first plate for each cell is arranged so as to form a first checkered pattern for the array; a second plate that is formed over the first plate, wherein the second plate is substantially rectangular, and wherein the first plate is substantially parallel to the second plate, and wherein the first and second plates are substantially aligned with a central axis that extends generally perpendicular to the first and second plates, and wherein the second plate for each cell is arranged so as to form a second checkered pattern for the array; and an interconnect formed between and coupled to the first and second plates.

In accordance with an embodiment of the present invention, the interconnect further comprises a via.

In accordance with an embodiment of the present invention, the via further comprises a first via, and wherein each cell further comprises a second via formed between the ground plane and the first plate.

In accordance with an embodiment of the present invention, the antenna further comprises a plurality of antennas.

In accordance with an embodiment of the present invention, the first and second plates are oriented such that the first and second checkered patters are generally coextensive.

In accordance with an embodiment of the present invention, each cell is about 420 μm×420 μm, and wherein the first via has a diameter of about 60 μm, and wherein the second via has a diameter of about 80 μm, and wherein the first distance is about 15 μm.

In accordance with an embodiment of the present invention, the first and second plates are oriented at an angle to one another.

In accordance with an embodiment of the present invention, an apparatus is provided. The apparatus comprises an antenna formed on a substrate; and an HIS formed along the periphery of the antenna, wherein the HIS includes: a ground plane formed on the substrate; a first dielectric layer formed over the ground plane; a first metallization layer formed over the first dielectric layer and that is patterned to form a plurality of first plates, wherein each first plate is associated with at least one of a plurality of cells that are arranged to form an array that substantially surrounds at least a portion of the antenna, and wherein each first plate has a generally perpendicular central axis, and wherein the plurality of first plates is arranged so as to form a first checkered pattern for the array; a second dielectric layer formed over the first metallization layer that is patterned to include a plurality of openings, and wherein each opening extends through the second dielectric layer to at least one of the plurality of first plates; a plurality of vias, wherein each via is formed in at least one of the plurality of openings; and a second metallization layer formed over the second dielectric layer and that is patterned to form a plurality of second plates, wherein each second plate is associated with at least one of the plurality of cells, and wherein each second plate is substantially aligned with the central axis of the first plate associated with its cell, and wherein the plurality of second plates is arranged so as to form a second checkered pattern for the array.

In accordance with an embodiment of the present invention, the plurality of openings further comprises a plurality of first openings, and wherein the plurality of vias further comprises a plurality of first vias, and wherein the HIS further comprises: a plurality of second opening, wherein each second opening extends through the first dielectric layer between at least one of the first plates and the ground plane; and a plurality of second vias, wherein each second via is formed in at least one of the plurality of second openings.

In accordance with an embodiment of the present invention, the first and second dielectric layers are formed of a glass epoxy and polymer film, respectively, and wherein the first and second metallization layers are formed of copper or aluminum.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
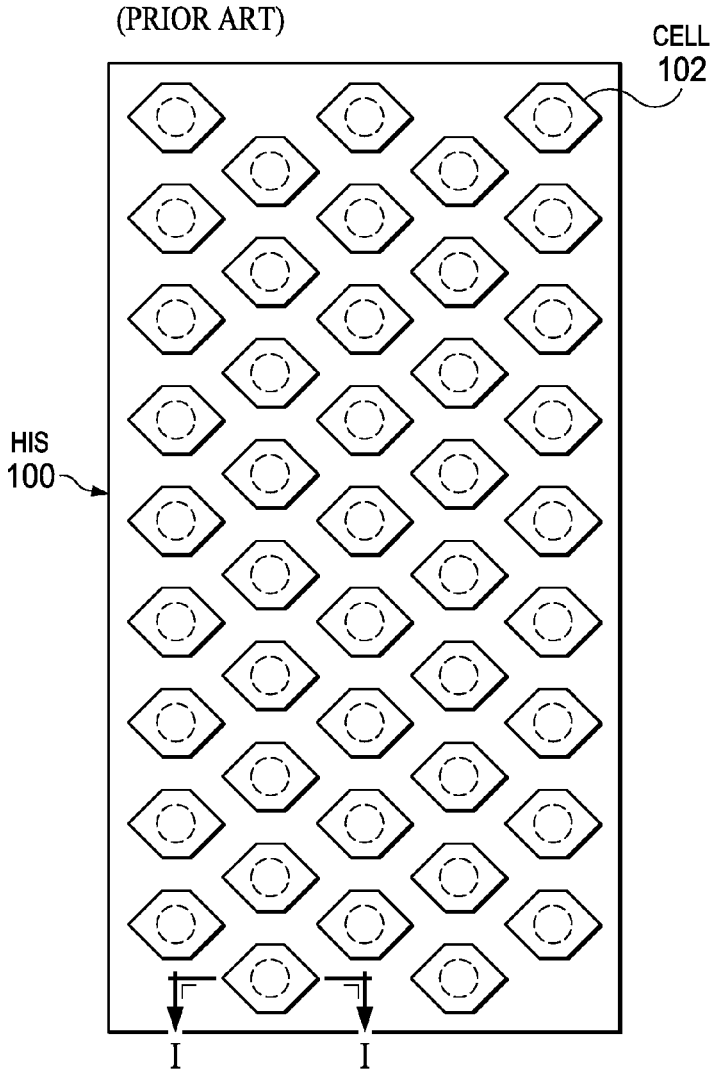
FIG. 1 (PRIOR ART)
FIG. 1 is a diagram of an example of a conventional HIS.
Figure 2:
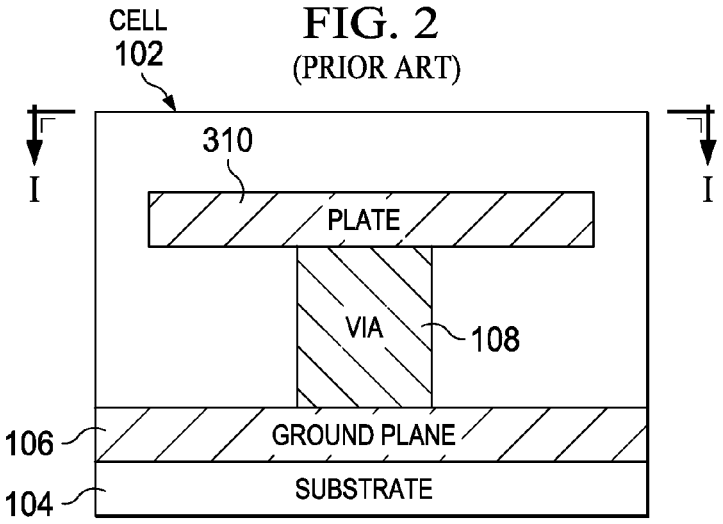
FIG. 2 (PRIOR ART)
FIG. 2 is a cross-sectional view of a cell of the HIS of FIG. 1 along section ling I-I.
Figure 3:
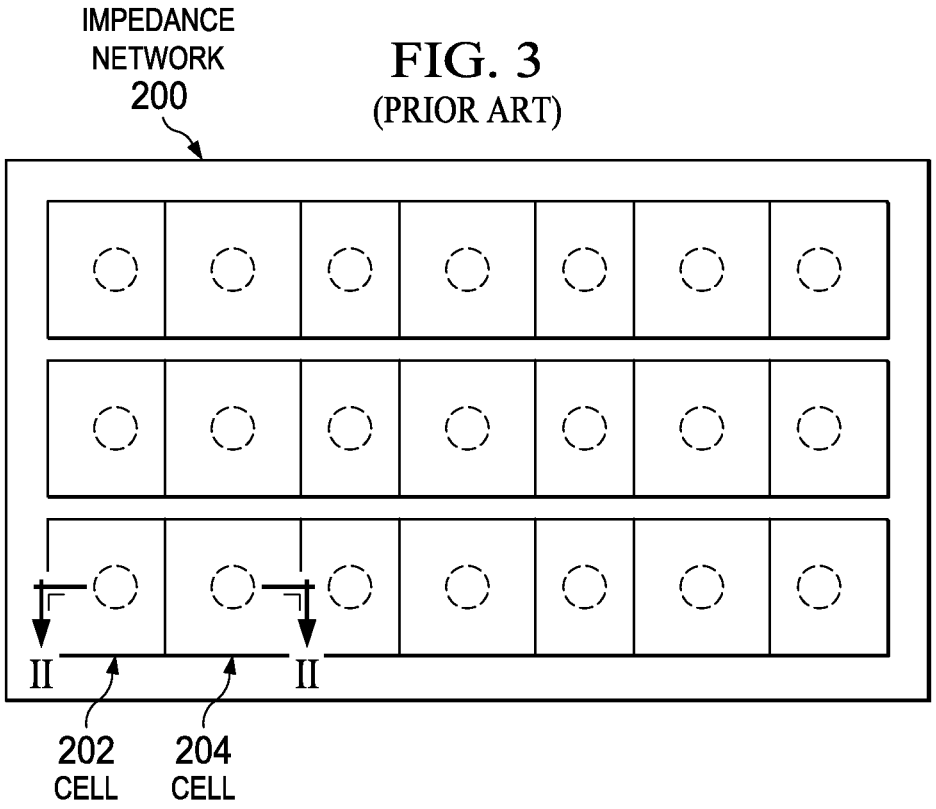
FIG. 3 (PRIOR ART)
FIG. 3 is a diagram of another example of another conventional HIS.

Refer now to the drawings wherein depicted elements are, for the sake of clarity, not necessarily shown to scale and wherein like or similar elements are designated by the same reference numeral through the several views.

Figure 5:
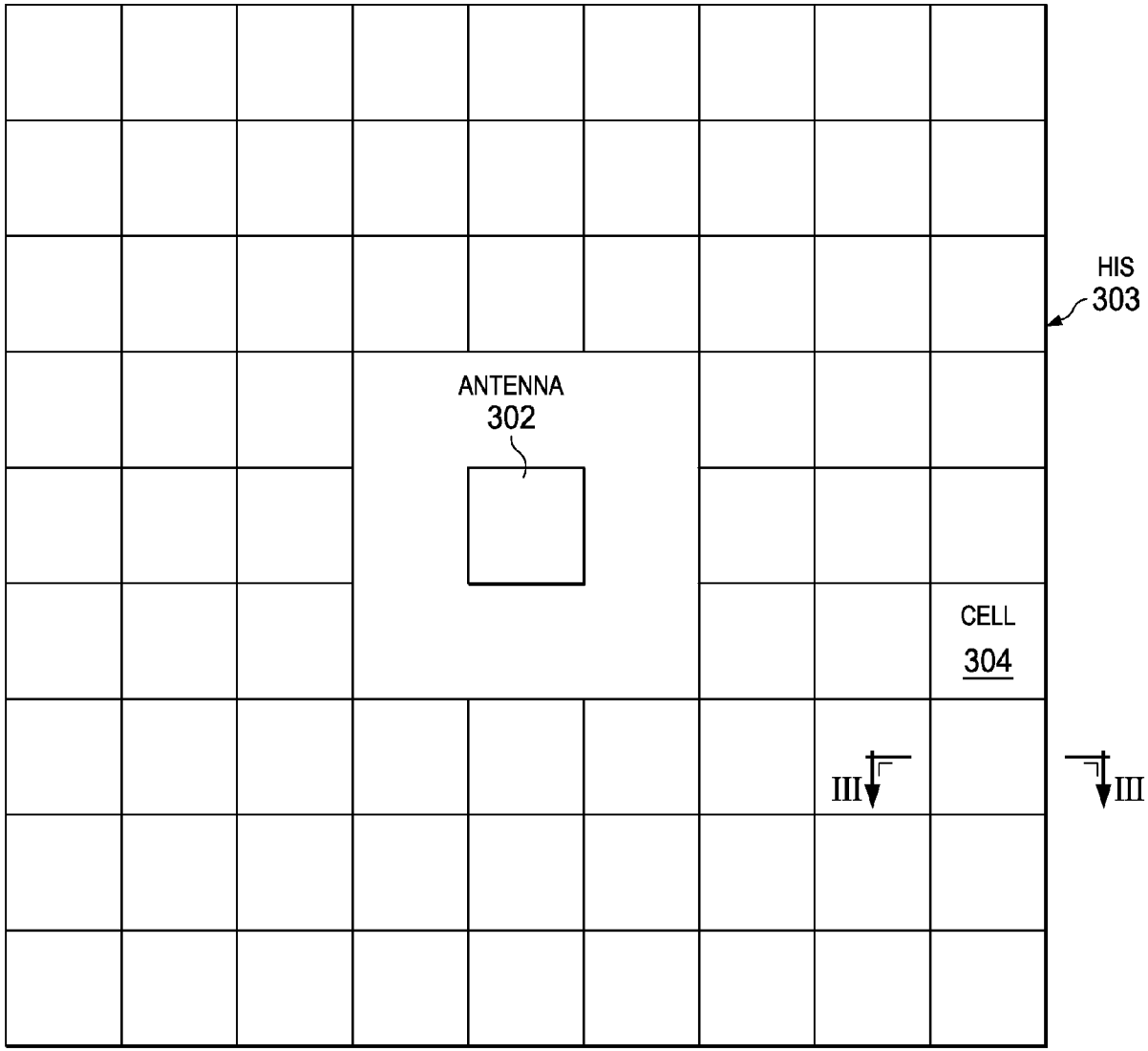
FIG. 5 is a diagram of an example of a radiating structure in accordance with an embodiment of the present invention.

Turning to FIG. 5, an example of a radiating structure in accordance with an embodiment of the present invention can be seen. As shown, the radiating structure is generally comprised of an antenna 302 (which can include one or more antennas or antenna elements) and an HIS 303. This HIS 303 is generally comprised of cells 304 that form an array to substantially surround the periphery of the antenna 302 so as to impede surface waves. In particular, the HIS 303 is generally tuned to have the same resonant frequency as the antenna 302 (which can, for example, be about 160 GHz).

Figure 6:
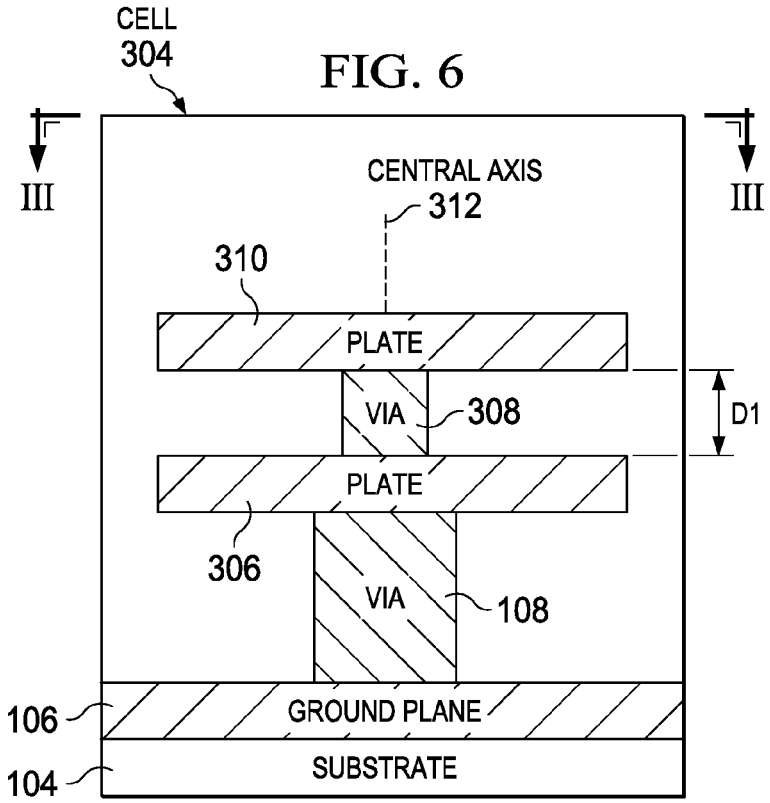
FIGS. 6 and 7 are examples of cross-sectional views of a cell of the HIS of FIG. 5 along section ling III-III.
Figure 7:
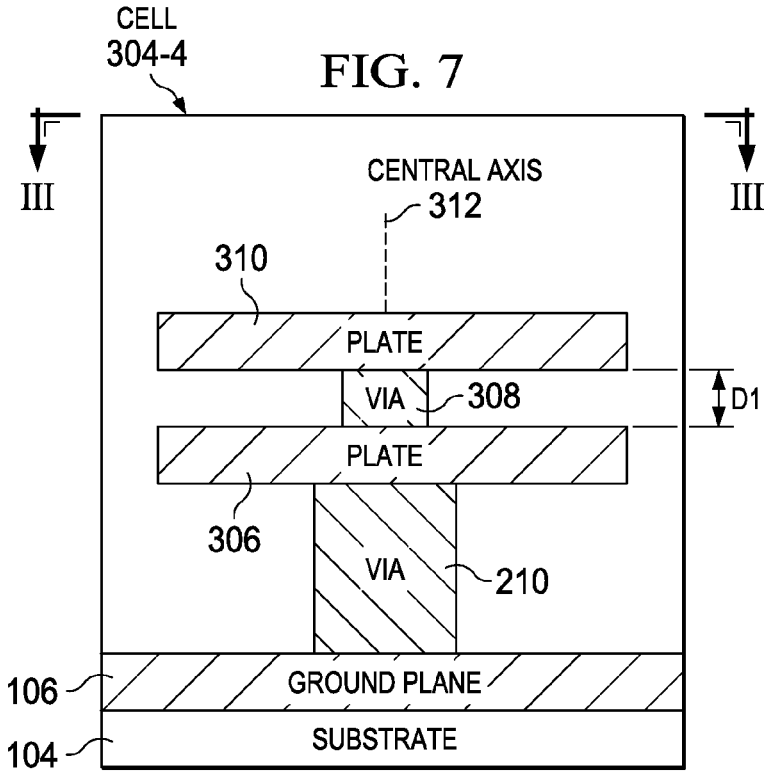

As shown in FIGS. 6 and 7, cell 304 is a multi-layer vertically stacked cell. Cell 304 is generally comprised of a ground plane 106, vias 210 and 308, and plates 306 and 310. As with cell 102, ground plane 106 is generally formed on a substrate 104, and via 108 is formed in a opening within a dielectric layer (which can, for example, be a glass epoxy) that is formed on the ground plane 106. Plates 306 and 310 (which can, for example, be formed of aluminum or copper) are generally parallel to one another and are separated by dielectric layer (i.e., polymer film) having a thickness (or distance between plates 306 and 310) of D1. Additionally, via 308 is formed in an opening in the dielectric layer between plates 306 and 310 is a via 308 (which can be aligned with via 210). The spacing between plates 306 and 310 or thickness D1 can affect the resonant frequency of the HIS 303 and can be varied according to the resonant frequency of the antenna 302. Each of the plates 306 and 310 is also aligned with a central axis 312 that is generally perpendicular to each of plates 306 and 310.

Figure 8:
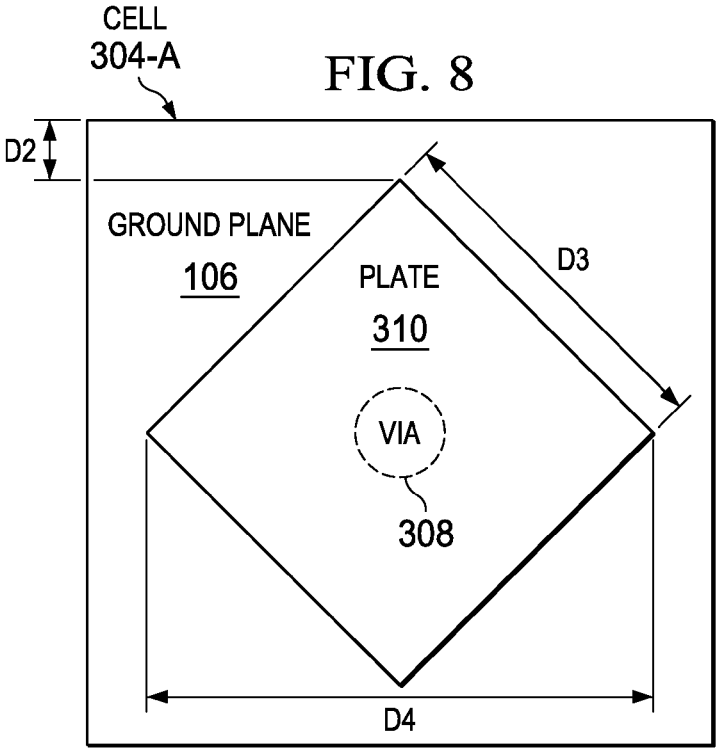
FIG. 8 is diagram of an example of plan view of a cell of the HIS of FIG. 5.
Figure 10:
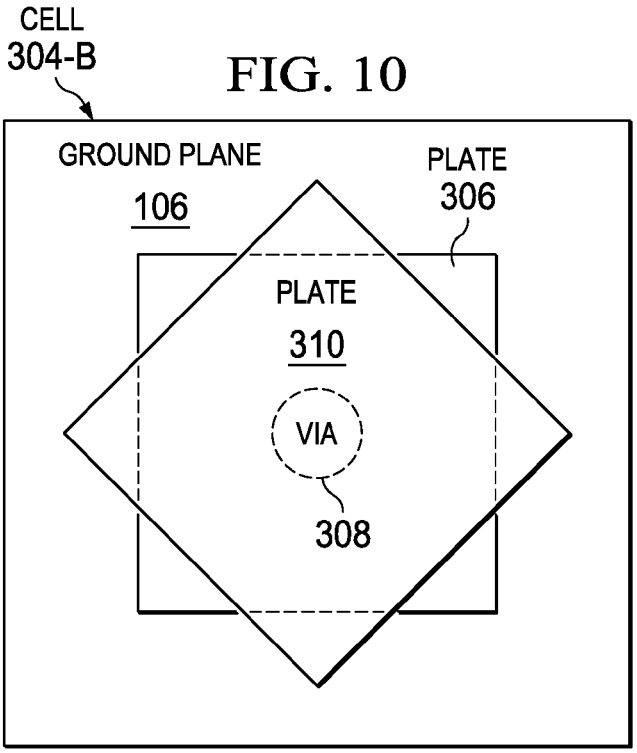
FIG. 10 is diagram of an example of plan view of a cell of the HIS of FIG. 5.
Figure 9:
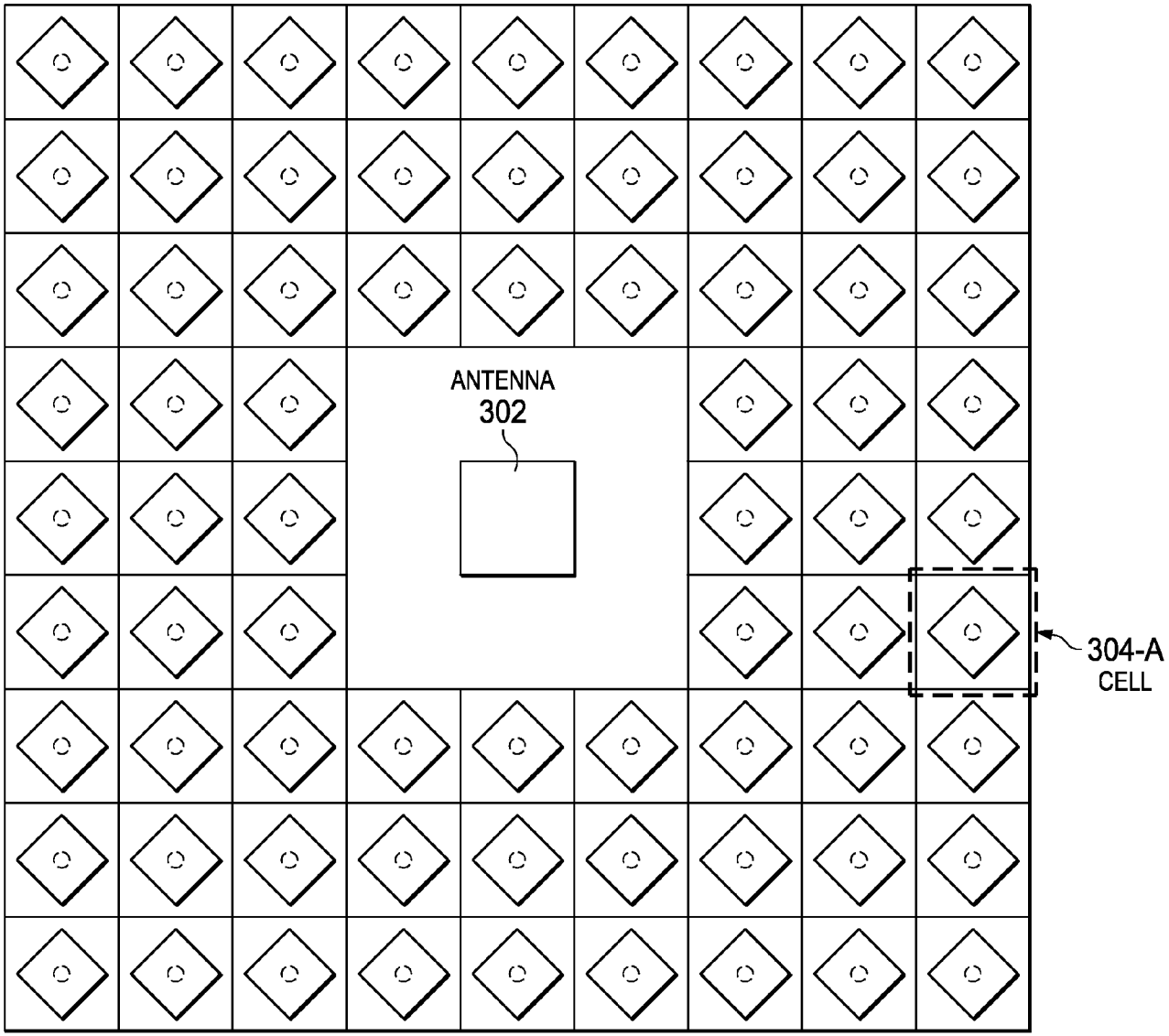
FIG. 9 is a diagram of the HIS of FIG. 5 employing the cell of FIG. 8.
Figure 11:
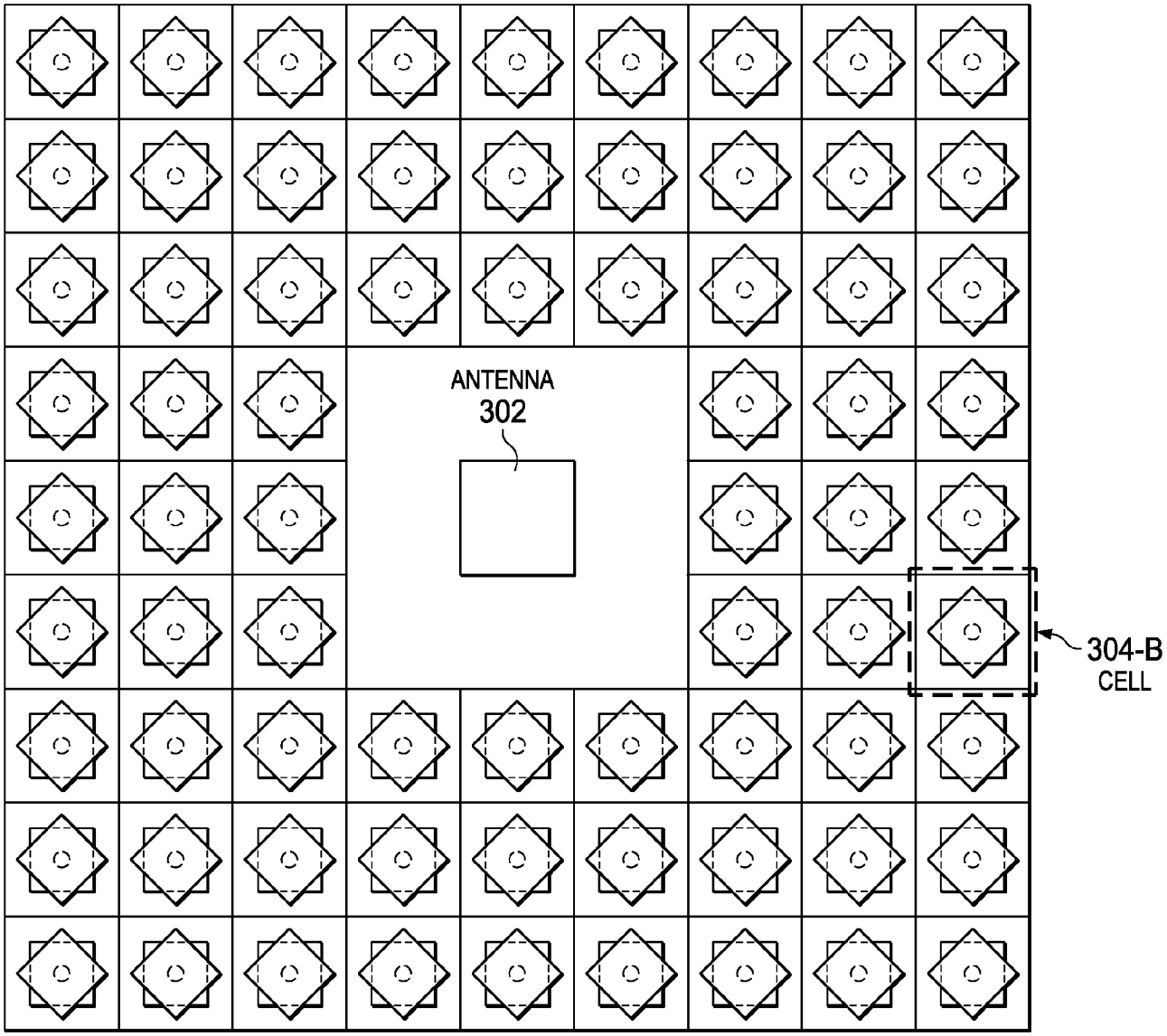
FIG. 11 is a diagram of the HIS of FIG. 5 employing the cell of FIG. 10.

Apart from the thickness D1, the arrangement of plates 306 and 310 can affect the resonant frequency of the HIS 303. In FIGS. 8 and 9, a plan view of cell 304 (which is labeled 304-A for this example) can be seen both individually and in HIS 303. As shown, plates 306 and 310 (which are generally aligned with one another in this example) do not occupy the entire cell 304-A, but, instead, are spaced from the edge of the cell 304-A by distance D2. Additionally, plates 310 and 306 are generally rectangular (i.e., square in this example). The dimensions of plates 306 and 310 (i.e., distances D3 and D4) as well as the distance D2 can affect the resonant frequency of the HIS 303. Nonetheless, plates 310 and 306 are generally arranged to form checkered patterns (which are generally coextensive in this example). These checkered patterns allow for generally constant proportion of metal and dielectric on the surface to be maintained so as allow the HIS 303 to be tuned to higher frequencies (i.e., high millimeter wave frequencies). Plates 310 and 306 may also be misaligned. As shown in FIGS. 10 and 11, plates 306 and 310 can be arranged to be at an angle with one another as shown with cell 304-B. Normally, plate 306 would not be visible, but for the sake of illustration it is shown, and in this example, plates 306 and 310 are arranged to be 45° apart.

Figure 4:
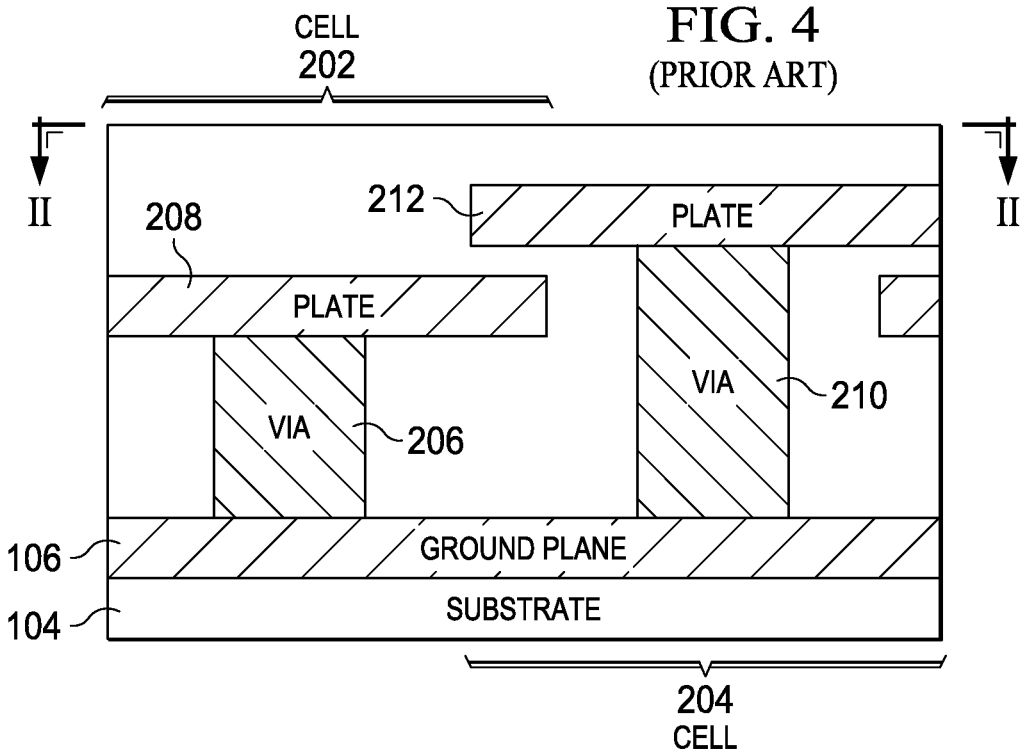
FIG. 4 (PRIOR ART)
FIG. 4 is a cross-sectional view of a cell of the HIS of FIG. 3 along section ling II-II.
Figure 12:
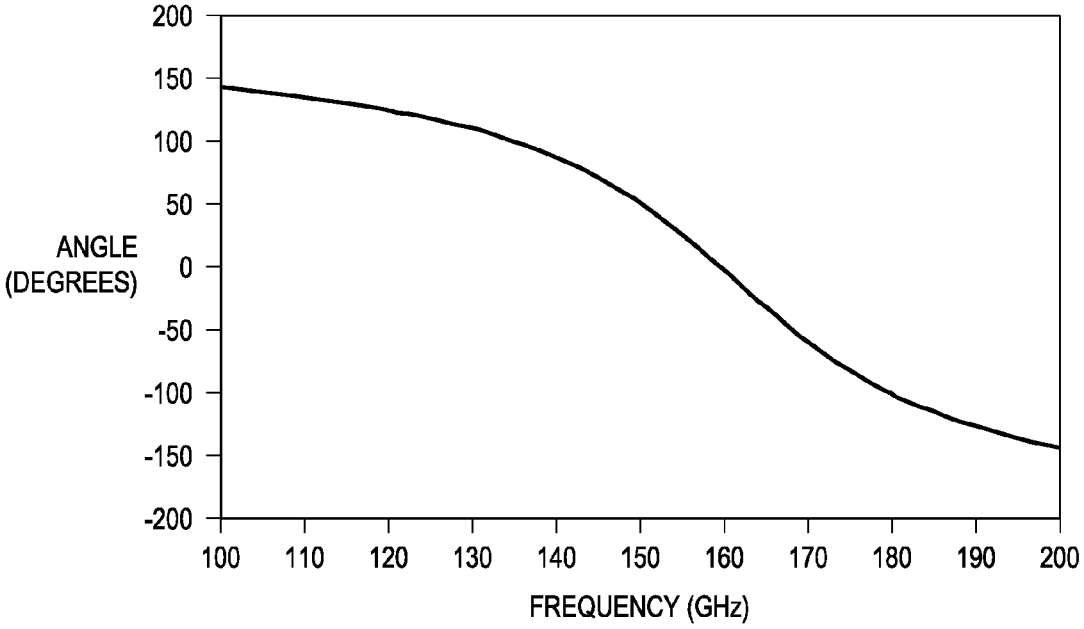
FIG. 12 is a diagram showing the operation of the radiating structure of FIG. 5.

Turning now to FIG. 12, a diagram depicting the operation (specifically, the angle of S11) of the radiating structure of FIG. 4 can be seen. As shown, antenna 302 has a resonance of about 160 GHz and the HIS 303 is tuned to about 160 GHz. For this example, cell 304-A (which is about 420 μm×about 420 μm) is employed. Vias 108 and 308 are also about 80 μm and about 60 μm in diameter, respectively, for this example. Plates 306 and 310 are also about 15 μm thick in this example, and distances D1, D2, D3, and D4 are about 20 μm, about 20 μm, about 270 μm, and about 381.1 μm, respectively, in this example.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

an antenna formed on a substrate; and a high impedance surface (HIS) having a plurality of cells formed on the substrate, wherein the plurality of cells are arranged to form an array that substantially surrounds at least a portion of the antenna, and wherein each cell includes:

a ground plane formed on the substrate;

a first plate that is formed over and coupled to the ground plane, wherein the first plate is substantially rectangular, and wherein the first plate for each cell is arranged so as to form a first checkered pattern for the array;

a second plate that is formed over the first plate, wherein the second plate is substantially rectangular, and wherein the first plate is substantially parallel to the second plate, and wherein the first and second plates are substantially aligned with a central axis that extends generally perpendicular to the first and second plates, and wherein the second plate for each cell is arranged so as to form a second checkered pattern for the array; and an interconnect formed between and coupled to the first and second plates wherein the interconnect further comprises a via;

wherein the via further comprises a first via, and wherein each cell further comprises a second via formed between the ground plane and the first plate;

wherein the first and second plates are oriented such that the first and second checkered patters are generally coextensive;

wherein each cell is about 420 μm×420 μm, and wherein the first via has a diameter of about 60 μm, and wherein the second via has a diameter of about 80 μm, and wherein the first distance is about 15 μm,

2. An apparatus comprising:

an antenna formed on a substrate; and an HIS formed along the periphery of the antenna, wherein the HIS includes:

a ground plane formed on the substrate;

a first dielectric layer formed over the ground plane;

a first metallization layer formed over the first dielectric layer and that is patterned to form a plurality of first plates, wherein each first plate is associated with at least one of a plurality of cells that are arranged to form an array that substantially surrounds at least a portion of the antenna, and wherein each first plate has a generally perpendicular central axis, and wherein the plurality of first plates is arranged so as to form a first checkered pattern for the array;

a second dielectric layer formed over the first metallization layer that is patterned to include a plurality of openings, and wherein each opening extends through the second dielectric layer to at least one of the plurality of first plates;

a plurality of vias, wherein each via is formed in at least one of the plurality of openings; and a second metallization layer formed over the second dielectric layer and that is patterned to form a plurality of second plates, wherein each second plate is associated with at least one of the plurality of cells, and wherein each second plate is substantially aligned with the central axis of the first plate associated with its cell, and wherein the plurality of second plates is arranged so as to form a second checkered pattern for the array;

wherein the plurality of openings further comprises a plurality of first openings, and wherein the plurality of vias further comprises a plurality of first vias, and wherein the HIS further comprises:

a plurality of second opening, wherein each second opening extends through the first dielectric layer between at least one of the first plates and the ground plane; and a plurality of second vias, wherein each second via is formed in at least one of the plurality of second openings;

wherein the first and second plates are oriented such that the first and second checkered patters are generally coextensive; and wherein each cell is about 420 μm×420 μm, and wherein each first via has a diameter of about 60 μm, and wherein each second via has a diameter of about 80 μm, and wherein the thickness is about 15 μm,

3. The apparatus of claim 2, wherein the first and second dielectric layers are formed of a glass epoxy and polymer film, respectively, and wherein the first and second metallization layers are formed of copper or aluminum.

* * * * *